US012702237B2

(12) United States Patent
Mostafa et al.

(10) Patent No.: US 12,702,237 B2
(45) Date of Patent: Aug. 11, 2026

(54) ELASTOMERIC CUSHIONING ELEMENTS WITH SUBSTANTIALLY CYLINDRICAL COLUMNS

(71) Applicant: Purple Innovation, LLC, Lehi, UT (US)

(72) Inventors: Ahmed Mostafa, Lehi, UT (US); Christopher Campagnoni, Park City, UT (US)

(73) Assignee: Purple Innovation, LLC, Lehi, UT (US)

( * ) Notice: Subject to any disclaimer, the term of this patent is extended or adjusted under 35 U.S.C. 154(b) by 125 days.

(21) Appl. No.: 18/528,273

(22) Filed: Dec. 4, 2023

(65) Prior Publication Data

US 2025/0176732 A1 Jun. 5, 2025

(51) Int. Cl.
*A47C 27/06* (2006.01)

(52) U.S. Cl.
CPC ..... *A47C 27/065* (2013.01)

(58) Field of Classification Search
CPC ..... A47C 27/065; A47C 27/06; A47C 27/04; A47C 27/061; A47C 27/062
See application file for complete search history.

(56) References Cited

U.S. PATENT DOCUMENTS 5,111,544 A * 5/1992 Graebe ..... A47C 7/021 5/490
5,749,111 A * 5/1998 Pearce ..... B29C 48/11 428/137
5,994,450 A * 11/1999 Pearce ..... C08L 51/006 524/505
7,730,566 B2 * 6/2010 Flick ..... A61G 7/05738 5/655.5
8,434,748 B1 5/2013 Pearce et al.
12,396,570 B2 * 8/2025 Newman ..... A47C 27/065
12,419,433 B1 * 9/2025 Grutta ..... A47C 27/085
2006/0253988 A1 11/2006 Pearce
2007/0107133 A1 5/2007 Schwaiger et al.
2010/0223730 A1 * 9/2010 Pearce ..... A47C 27/20 5/652
2010/0227091 A1 * 9/2010 Pearce ..... B32B 3/08 428/36.1
2018/0078062 A1 * 3/2018 Pearce ..... A47G 9/1027
(Continued)

FOREIGN PATENT DOCUMENTS

CN 2493099 Y 5/2002
EP 0793932 A1 * 9/1997 ..... A47G 9/10
(Continued)

OTHER PUBLICATIONS

International Search Report and Written Opinion on PCT/US2024/058144 Dtd Feb. 5, 2025.

*Primary Examiner* — David E Sosnowski
(74) *Attorney, Agent, or Firm* — Foley & Lardner LLP

(57) ABSTRACT

A cushioning element includes interconnected walls that define voids and hollow columns that are substantially cylindrical or cylindrical in shape. Some of the interconnected walls may project laterally from a wall that defines part of a hollow column to further define part of an interspace between a group of hollow columns. Methods of designing cushioning elements with hollow columns that are substantially cylindrical or cylindrical are also disclosed.

7 Claims, 12 Drawing Sheets

(56) References Cited

U.S. PATENT DOCUMENTS

| | | | | |
|---|---|---|---|---|
| 2018/0305199 | A1* | 10/2018 | Pearce | A47G 9/10 |
| 2019/0000247 | A1* | 1/2019 | Ko | B60N 2/7094 |
| 2019/0003549 | A1* | 1/2019 | Dahl | B32B 27/08 |
| 2021/0079970 | A1 | 3/2021 | Betteridge et al. | |
| 2022/0053937 | A1* | 2/2022 | Lee | A47C 7/18 |
| 2024/0023723 | A1* | 1/2024 | Mostafa | A47C 27/144 |
| 2024/0251962 | A1* | 8/2024 | Mostafa | A47C 27/144 |
| 2024/0251963 | A1* | 8/2024 | Mostafa | A47C 27/144 |
| 2024/0251964 | A1* | 8/2024 | Bin | A47C 27/148 |
| 2024/0285088 | A1* | 8/2024 | Tar | A47C 27/15 |
| 2024/0389762 | A1* | 11/2024 | Liao | A47C 27/062 |
| 2024/0398129 | A1* | 12/2024 | Leng | A47C 27/062 |
| 2025/0151935 | A1* | 5/2025 | Williams | A47G 9/10 |
| 2025/0194810 | A1* | 6/2025 | Leng | A47C 27/063 |
| 2025/0194817 | A1* | 6/2025 | Leng | A47C 27/07 |
| 2025/0268389 | A1* | 8/2025 | Peterson | A47C 27/07 |
| 2025/0268390 | A1* | 8/2025 | Peterson | A47C 27/066 |
| 2025/0268393 | A1* | 8/2025 | Peterson | A47C 27/16 |
| 2026/0013646 | A1* | 1/2026 | Acharya | A47C 7/027 |

FOREIGN PATENT DOCUMENTS

| | | | | |
|---|---|---|---|---|
| EP | 1872692 | A1 * | 1/2008 | A47C 27/065 |
| EP | 3798464 | A1 * | 3/2021 | B32B 27/08 |
| WO | WO-2009023940 | A1 * | 2/2009 | B26D 3/10 |

* cited by examiner

| Type | Grid Height | Weight (lb) |
|---|---|---|
| Standard | 3 | 65 |
| Standard | 4 | 86 |
| Optimized | 3 | 51.57 |

FIG. 9A

| Geometry | Cell Volume | % Reduction material of Baseline |
|---|---|---|
| Standard - 3 in | 2.70 | NA |
| Octagonal Grid-square intersection | 2.32 | 14.07% |
| Octagonal Grid-circular intersection | 2.20 | 18.52% |

FIG. 9B

ELASTOMERIC CUSHIONING ELEMENTS WITH SUBSTANTIALLY CYLINDRICAL COLUMNS

TECHNICAL FIELD

This disclosure relates generally to cushioning elements and, more specifically, to elastomeric cushioning elements with interconnected walls that define voids.

RELATED ART

Cushions made of elastomeric materials can be heavy and cumbersome to ship and handle. Typically, the elastomeric materials are formed into some sort of array, which can be incorporated into a shape of the final cushion. The formed arrays can include grids, or tessellated arrangements, of square or diamond shaped columns, which are intended to respond to applied forces, such as the weight of a human being. Generally, the formed cushions are heavy and utilize a lot of material, increasing costs of manufacturing and shipping the cushion.

SUMMARY

Disclosed are systems, devices, and/or methods of use thereof regarding cushioning elements and, more specifically, cushioning elements formed from elastomeric gels. Such a cushioning element may include a plurality of interconnected walls that define voids, with the walls that define each void and the void they define comprising a hollow column of the cushioning element. The hollow column, including its walls and void, may have a configuration that enables the walls and, thus, the column, when a sufficient load is applied to the hollow column.

In various aspects, a cushion includes an elastomeric cushioning element having (i) a plurality of hollow columns that are cylindrical or substantially cylindrical in shape and (ii) a plurality of interspaces, which comprise the spaces between a group of the hollow columns (e.g., at least three hollow columns, four hollow columns, etc.) (i.e., by the outer surfaces of the hollow columns) that are joined together (e.g., as the corners of a polygon, etc.). Optionally, an elastomeric cushioning element may include (iii) at least one lateral projection extending from an outer surface of each of the hollow columns to join it to an adjacent hollow column; in such an embodiment, the group of hollow columns that are joined together and the lateral projections that join the group of hollow columns together may define an interspace between each group of hollow columns.

In various aspects, a method of forming a cushion includes forming a plurality of substantially hollow columns from an elastomeric material, where each of the hollow columns has an interior surface and an outer surface. The method may also include forming lateral projections that extend laterally from different locations of the outer surface of each hollow column. Each lateral projection may join a hollow column to another hollow column. Thus, the lateral projections and the plurality of hollow columns define a plurality of interspaces between the hollow columns.

In various aspects, a method of forming a cushion includes introducing an elastomeric material into a mold, where the mold defines a plurality of hollow columns. The method further includes forming lateral projections on an outer surface of each of the plurality of hollow columns. Each lateral projection may join a hollow column to an adjacent hollow column. The lateral projections and the plurality of hollow columns (i.e., the outer surfaces thereof) may define an interspace. The method may also include removing the cushion from the mold.

Other aspects of the disclosed subject matter, as well as features and advantages of various aspects of the disclosed subject matter, should be apparent to those of ordinary skill in the art through consideration of the ensuing description, the accompanying drawings, and the appended claims.

BRIEF DESCRIPTION OF THE DRAWINGS

In the drawings:

FIGS. 9A-9B are tables comparing the weight and amount of material used from the cushioning elements of FIGS. 1, 4, and 5 with a cushioning element having square hollow columns arranged in a grid.

DETAILED DESCRIPTION

Figure 1:
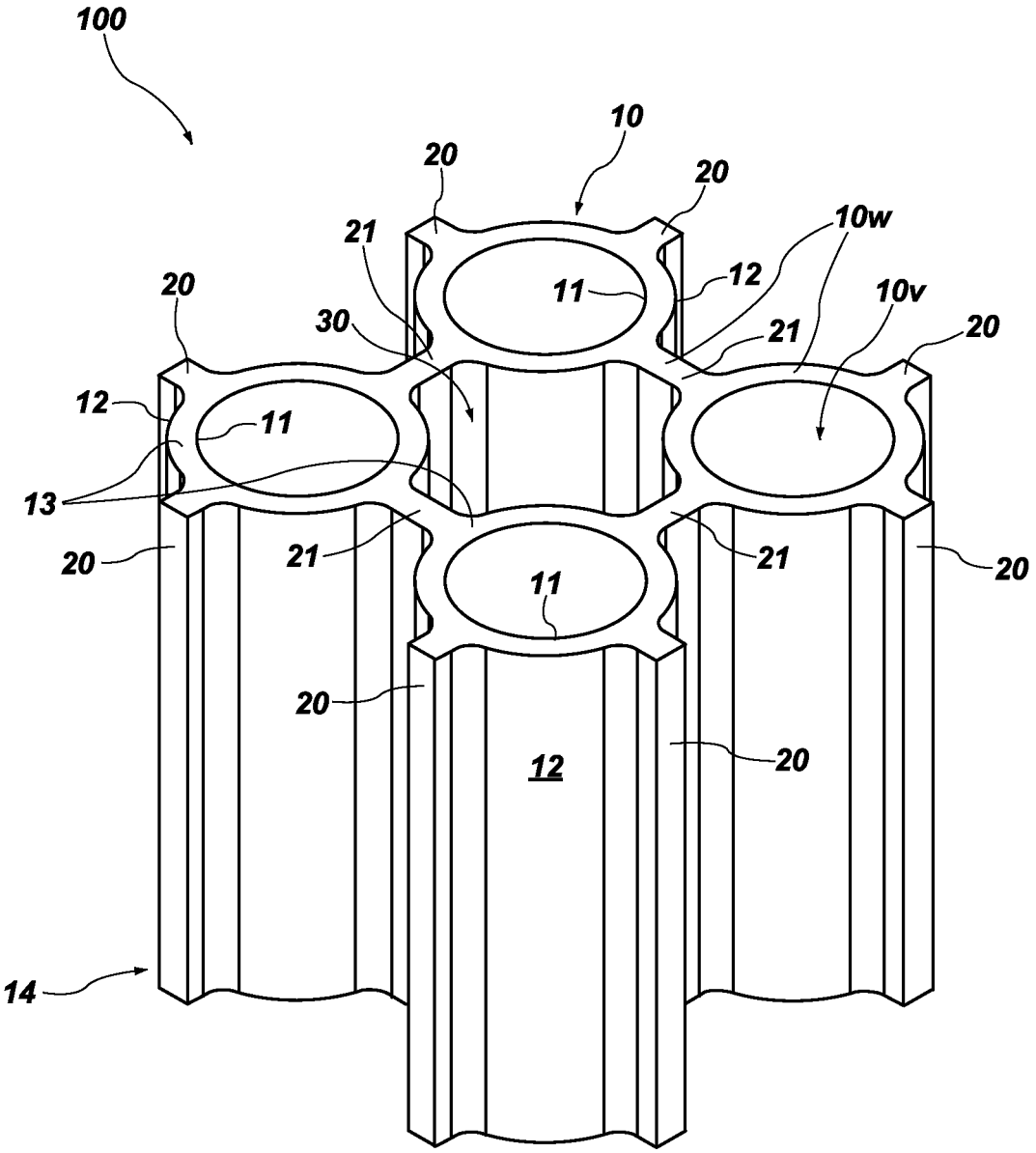
FIG. 1 illustrates a perspective partial view of an embodiment of a cushioning element having hollow columns that are cylindrical or substantially cylindrical in shape and interspaces between the hollow columns.

FIG. 1 is a perspective view of a part or section of a cushioning element 100 formed from an elastomeric material. Examples of elastomeric materials appropriate for forming cushioning elements are illustrated and described in U.S. Pat. No. 5,994,450, titled "GELATINOUS ELASTOMER AND METHODS OF MAKING AND USING THE SAME," and issued on Nov. 30, 1999, the entire contents of which are incorporated herein by reference. Such a material may be referred to as an "elastomeric gel" or more simply as a "gel." Specifically, the elastomeric material is formed to define a plurality of interconnected walls 10*w* that define voids 10*v*, with the walls 10*w* that define each void 10*v* and the void 10*v* comprising a hollow column 10 of the cushioning element 100. Each hollow column 10, including its void 10*v* and its walls 10*w* may be cylindrical or substantially cylindrical in shape. Each hollow column 10 includes an interior surface 11 and an outer surface 12. The hollow columns 10 may have cross-sectional shapes, taken perpendicular to their longitudinal axes, or heights, that are round. For example, a hollow column 10 may have a circular or substantially circular cross-sectional shape, as illustrated by FIG. 1. Alternatively, the cross-sectional shape of a hollow column 10 may be ovular, elliptical, or another round shape. Alternatively, the hollow columns 10 may be substantially round in shape, such as a star shape or another shape that has eight or more faces (e.g., 8 faces, 10 faces, 12 faces, 18 faces, 24 faces, etc.). In some embodiments, an array of hollow columns 10 includes a mixture of r round and/or substantially round cross-sectional shapes.

The interior surface 11 of each hollow column 10 defines a hollow interior, or the void 10*v* or cell, of the hollow column 10. A cross-sectional shape of the void 10*v*, taken perpendicular to a longitudinal axis, or a height, of the void 10*v*, may be the same as or different from the cross-sectional shape of the hollow column 10.

At least one lateral projection 20 extends from the outer surface 12 of each hollow column 10. In some embodiments, two lateral projections 20, three lateral projections 20, four lateral projections 20, or more protrude from the outer surface 12 of each hollow column 10. In embodiments where an even number of lateral projections 20 protrude from the outer surface 12 of each hollow column 10, the lateral projections 20 may be symmetrically disposed about the outer surface 12 of the hollow columns 10. At least one lateral projection 20 protruding from a hollow column 10 may extend to an adjacent hollow column 10 to join the adjacent hollow column 10 together. For example, illustrated in FIG. 1 are four lateral projections 20 connecting four adjacent hollow columns 10. More specifically, FIG. 1 shows four hollow columns 10 arranged as the corners of a square and four lateral projections 20 positioned along the sides of the square to join each pair of hollow columns 10 located closest to each other.

It will be appreciated that any number of hollow columns 10 may be joined to form a grid, or array. The lateral dimensions of the grid may be the substantially the same as (e.g., at least 75% of, at least 80% of, at least 85% of, at least 90% of, at least 95% of, etc.) the lateral dimensions of a mattress (e.g., a twin mattress, a twin XL mattress, a full or double mattress, a queen mattress, a king mattress, a California king mattress, etc.). The lateral dimensions of the grid may be substantially the same as (e.g., at least 75% of, at least 80% of, at least 85% of, at least 90% of, at least 95% of, etc.) the lateral dimensions of a side, or a half, of a mattress (e.g., a queen mattress, a king mattress, a California king mattress, etc.). The grid may comprise a tile that may be arranged with other tiles in a mattress or another cushion. The grid may have a shape that corresponds or substantially corresponds to a shape of a cushion (e.g., a seat cushion, a pillow, etc.)

Figure 2A:
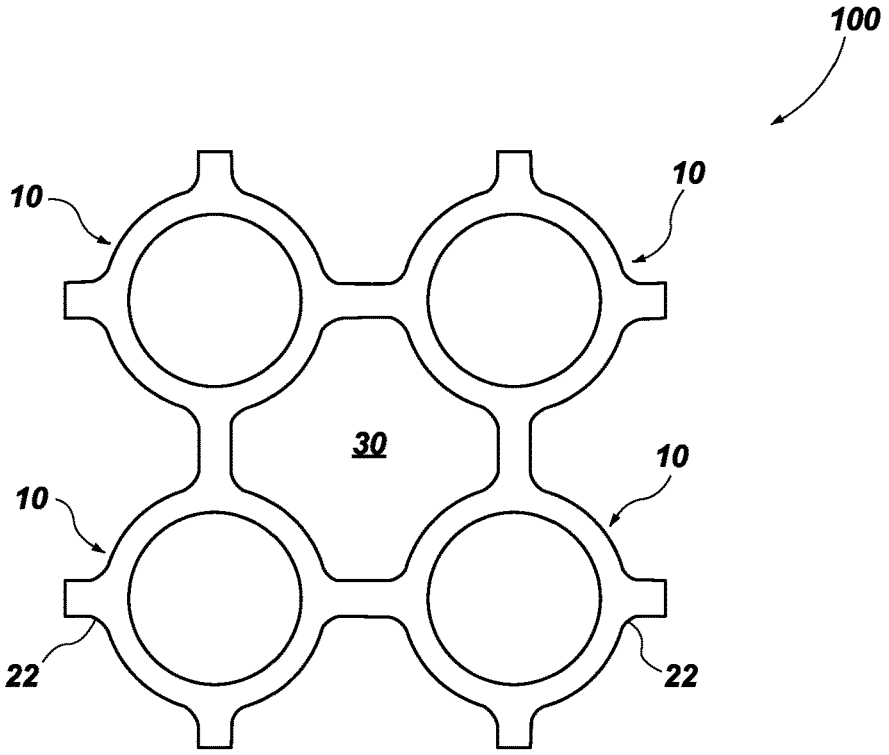
FIG. 2A is a plan view of a section of the cushioning element of FIG. 1.

Spaces between a group of the lateral projections 20 and the outer surfaces 12 of a group of the hollow columns 10 the lateral projections 20 group together are referred to herein as "interspaces 30." A cross-sectional shape of each interspace 30 taken perpendicular to its longitudinal axis, or height, may correspond to the shapes of the outer surfaces 12 of the hollow columns 10 and the arrangement of the lateral projections 20. For example, the cross-sectional shape of an interspace 30 may be a polygon with inverted (e.g., concave, etc.) or beveled corners. In the embodiment depicted by FIGS. 1 and 2A, the cross-sectional shape of the interspace 30 has inverted rounded corners 32. More specifically, the cross-sectional shape of the interspace 30 shown in FIGS. 1 and 2A is a square with inverted rounded corners 32. Even more specifically, the cross-sectional shape of the interspace 30 has a rounded "plus" (+) configuration, with four faces 31 and four concavely rounded corners 32. As shown, the cross-sectional area of each hollow column 10, taken perpendicular to the longitudinal axis, or height, of the hollow column 10, may be about the same as the cross-sectional area of each interspace 30, taken perpendicular to the longitudinal axis, or height, of the interspace 30. Optionally, the cross-sectional area of each hollow column 20 may be larger than the cross-sectional area of each interspace 30 (see, e.g., FIG. 4). As another option, the cross-sectional area of each hollow column 20 may be smaller than the cross-sectional area of each interspace 30 (see, e.g., FIG. 5).

The hollow columns 10, the lateral projections 20, and the interspaces 30 may be define an array or a grid.

In some embodiments, some or all of the hollow columns 10 and the interspaces 30 may extend from a top surface 113 to a bottom surface 114 of the cushioning element 100. Specifically, a thickness or height of the cushioning element 110 may be the distance from its top surface 113 to its bottom surface 114 (e.g., as measured perpendicular to the top surface 113 and bottom surface 114, etc.). A height of each hollow column 10 and a height of each lateral projection 20 may be the same as the thickness or height of the cushioning element 100. As illustrated, the lateral projections 20 may also extend from the top surface 113 to the bottom surface 114, or have heights that are the same as the thickness or height of the cushioning element. Alternatively, the lateral projections 20 may extend only partially between the top surface 113 and the bottom surface 114 and, thus, have heights that are less than the thickness or height of the cushioning element 100. In some embodiments where a lateral projection 20 extends only partially between the top surface 113 and the bottom surface 114, a plurality of lateral projections 20 may be aligned with each other through the thickness or height of the cushioning element 100.

Figure 3:
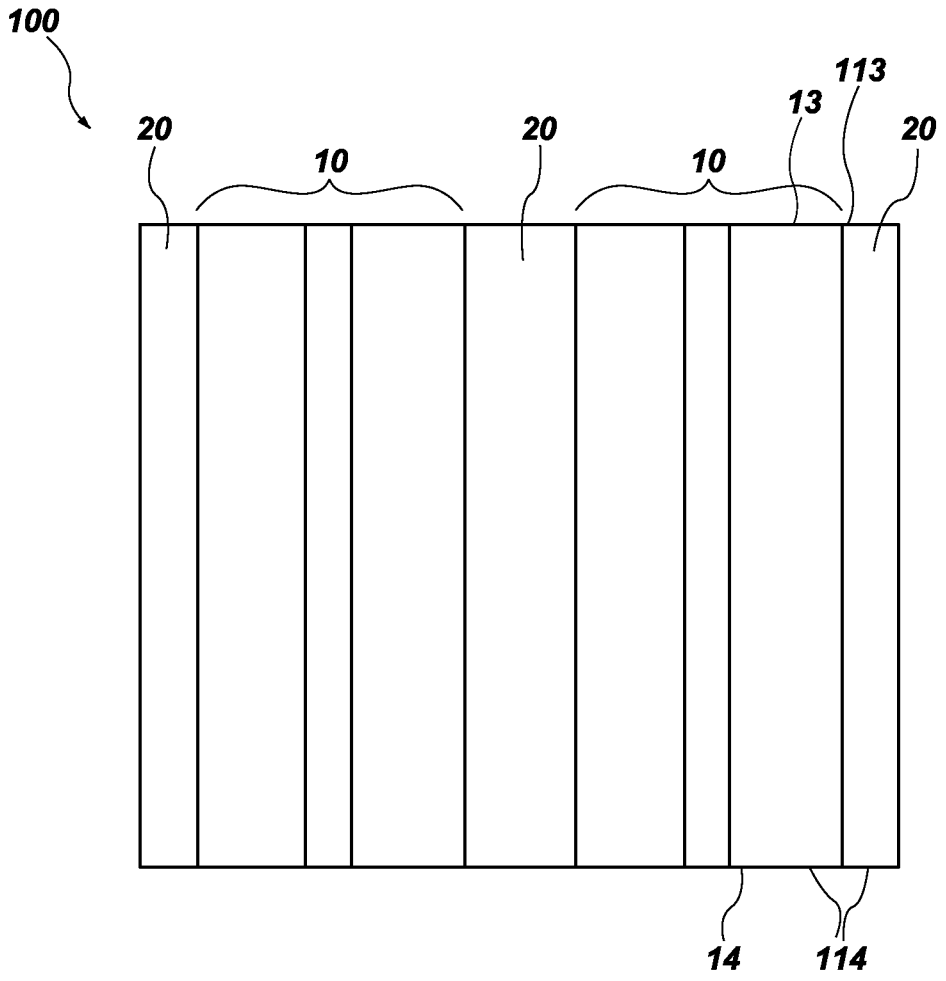
FIG. 3 is a side view of a section of the cushioning element of FIG. 1.

Referring briefly to FIG. 3, a thickness or height of the cushioning element 100 and, thus, a height of each hollow column 10, a height of each interspace 30 (FIGS. 1 and 2A) and, optionally, a height of each lateral projection 20 may range from about 1 cm to about 11 cm (about 0.4 to about 4.5 inches), such as about 1, 2, 3, 4, 4.5, 5, 5.5, 6.5, 7, 7.5, 8, 8.5, 9, 9.5, 10, 10 cm, or a height within a range defined by any two of the foregoing values. In some embodiments, a height of the hollow columns 10 corresponds to a thickness of the cushioning element 100. In other embodiments, the heights of some or all of the hollow columns 10 and interspaces 30 are less than the thickness or height of the cushioning element 100, with such hollow columns 10 and interspaces 30 extending only partially through the thickness or height of the cushioning element 100. For example, all or part of the top surface 113 or bottom surface 114 of the cushioning element 100 may be solid, with the solid portion defining an end of at least some of the hollow columns 10 and/or interspaces 30.

In some embodiments, in some areas of the cushioning element 100 or across an entirety of the cushioning element 100, the hollow columns 10 are the same height. Optionally, the lateral projections 20 of such areas may be the same height as each other and as the corresponding hollow columns 10. Thus, the top surface 13 of each hollow column 10 and, optionally, the top surface of each lateral projection 20 in such an area forms a planar area of the top surface 113 of the cushioning element 110. Concomitantly, the bottom surface 14 of each hollow column 10 and, optionally, the bottom surface of each lateral projection 20 of such an area forms a planar area of the bottom surface 114 of the cushioning element 110. As the interspaces 30 are defined by the hollow columns 10 and the lateral projections 20, a height of each interspace 30 in such a region of a cushioning element may match or correspond to the heights of the hollow column 10 and, optionally, the heights of the lateral projections 20.

Figure 2B:
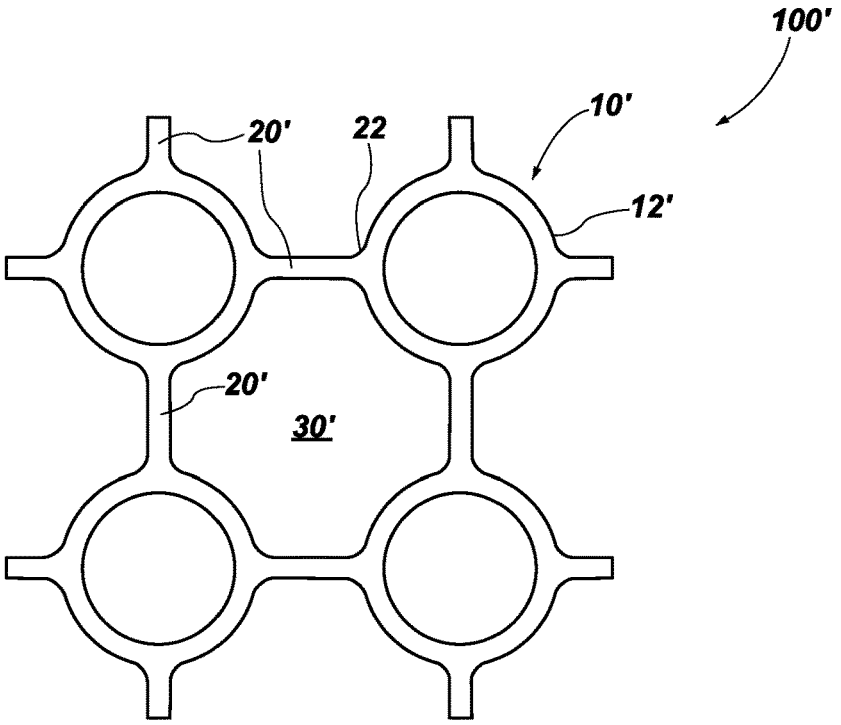
FIG. 2B is a top plan view of another embodiment of a cushioning element.
Figure 2C:
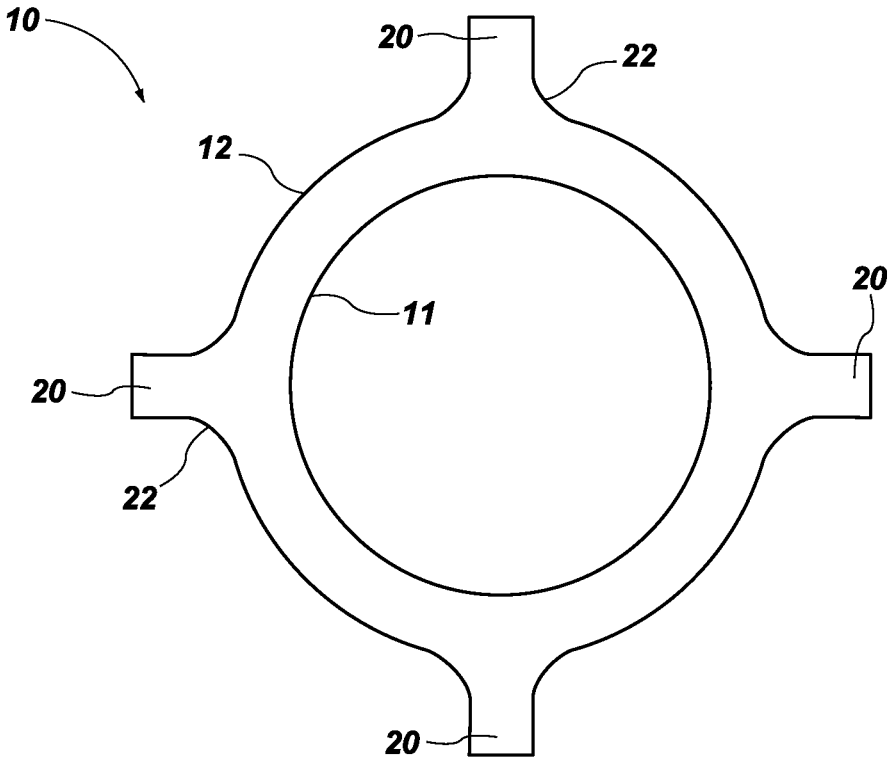
FIG. 2C shows a hollow column of a cushioning element of this disclosure in detail.

FIGS. 2A-2C illustrate various dimensions and measurements of specific, but non-limiting embodiments of various features of cushioning elements 100 and 100'. For example, as shown in FIG. 2A, a cushioning element 100 may include hollow columns 10 spaced equidistant from each other in a square grid. Each hollow column 10 has an inner diameter of 1.000 inch (2.540 cm) and an outer diameter of 1.300 inches (3.300 cm) (an outer radius of 0.650 inch or 1.650 cm). Centers of the closest adjacent hollow columns 10 (i.e., those forming the corners of a square) are positioned 1.750 inches (4.445 cm) apart from each other, meaning that each lateral projection 20 has a length of 0.450 inch (1.143 cm) (i.e., the 1.750 inch spacing between the adjacent hollow columns 10—(2×the 0.650 inch outer radii of each of the adjacent hollow columns 10=0.450 inch). Each hollow column 10 has a wall thickness of 0.150 inch (0.381 cm) (i.e., (the 1.300 inch outer diameter of the hollow column 10—the 1.000 inch inner diameter of the hollow column 10)/2=0.150 inch), while each lateral projection 20 has a wall thickness of 0.200 inch (0.508 cm).

FIG. 2B shows another example of a cushioning element 100' that also includes hollow columns 10' spaced equidistant from each other in a square grid. Each hollow column 10' has an inner diameter of 1.000 inch (2.540 cm) and an outer diameter of 1.300 inches (3.300 cm) (an outer radius of 0.650 inch or 1.650 cm). Centers of the closest adjacent hollow columns 10' (i.e., those forming the corners of a square) are positioned 2.000 inches (5.080 cm) apart from each other, meaning that each lateral projection 20' has a length of 0.700 inch (1.778 cm) (i.e., the 2.000 inch spacing between the adjacent hollow columns 10'—(2×the 0.650 inch outer radii of each of the adjacent hollow columns 10'=0.700 inch). Each hollow column 10' has a wall thickness of 0.150 inch (0.381 cm) (i.e., (the 1.300 inch outer diameter of the hollow column 10'—the 1.000 inch inner diameter of the hollow column 10')/2=0.150 inch), while each lateral projection 20' has a wall thickness of 0.140 inch (0.356 cm).

As shown in FIGS. 2A and 2B, as well as in FIG. 2C, each transition between the outer surface 12, 12' of a hollow column 10, 10' and the outer surface of a lateral projection 20, 20' may be referred to as a shoulder 22. The shoulders 22 may be radiused. As FIGS. 2A-2C illustrate, the radius of the shoulder 22 may be 0.150 inch (0.381 cm).

More generally, each of the hollow columns 10 may have an outer diameter of about 0.500 inch (about 1.270 cm) to about 2.500 inches (about 6.350 cm). An inner diameter of the hollow columns 10 may be about 0.400 inch (about 1.016 cm) to about 2.400 inches (about 6.096 cm). A distance between a center of a first hollow column 10 and a center of an closest adjacent second hollow column 10 may be about 1.500 inches (about 3.810 cm) to about 4.500 inches (about 11.430 cm). Other suitable ranges of outer diameters and inner diameters may also be may be utilized for the hollow columns 10.

The lateral projections 20 may have any of a variety of thicknesses. For example the lateral projections 20 may have a thickness of about 0.08 inch (about 0.2 cm) to about 0.25 inch (about 0.635 cm). The shoulders 22 where each lateral projection 20 meets or joins the outer surface 12 of a hollow column 10 may have a radius of curvature of about 0.100 inch (about 0.254 cm) to about 0.300 inch (about 0.76 cm).

As indicated previously herein, a length of each lateral projection 20 may be correlated to the distance between the center of a first hollow column 10 and a center of a second hollow column 10 the lateral projection 20 extends between. Additionally, the length of each lateral projection 20 may be correlated to the outer radius or outer diameter of the outer surface 12 of the hollow columns 10 between which the lateral projection extends.

As described previously herein, the shape of the interspace 30 within each group of hollow columns 10 may be defined by the shapes of the hollow columns 10 of the group and the lateral projections 20 that join the hollow columns 10 of the group. Additionally, a size of the interspace 30 may correspond to a size of both the hollow columns 10 of the group and the lateral projections 20 that join the hollow columns of the group. For example, in embodiments where the hollow columns 10 are smaller than the embodiments shown in FIGS. 2A and 2B but the distance between the centers of the hollow columns 10 remains the same, the lateral projections 20 connecting adjacent hollow columns 10 will be longer. Consequently, the straight faces 31 of the interspace 30 will also be longer and its inverted corners 32 will be smaller (i.e., have smaller radii), as the straight faces 31 are defined by the lateral projections 20 and the corners 32 are defined by portions of the outer surfaces 12 of the hollow columns 10.

Figure 4:
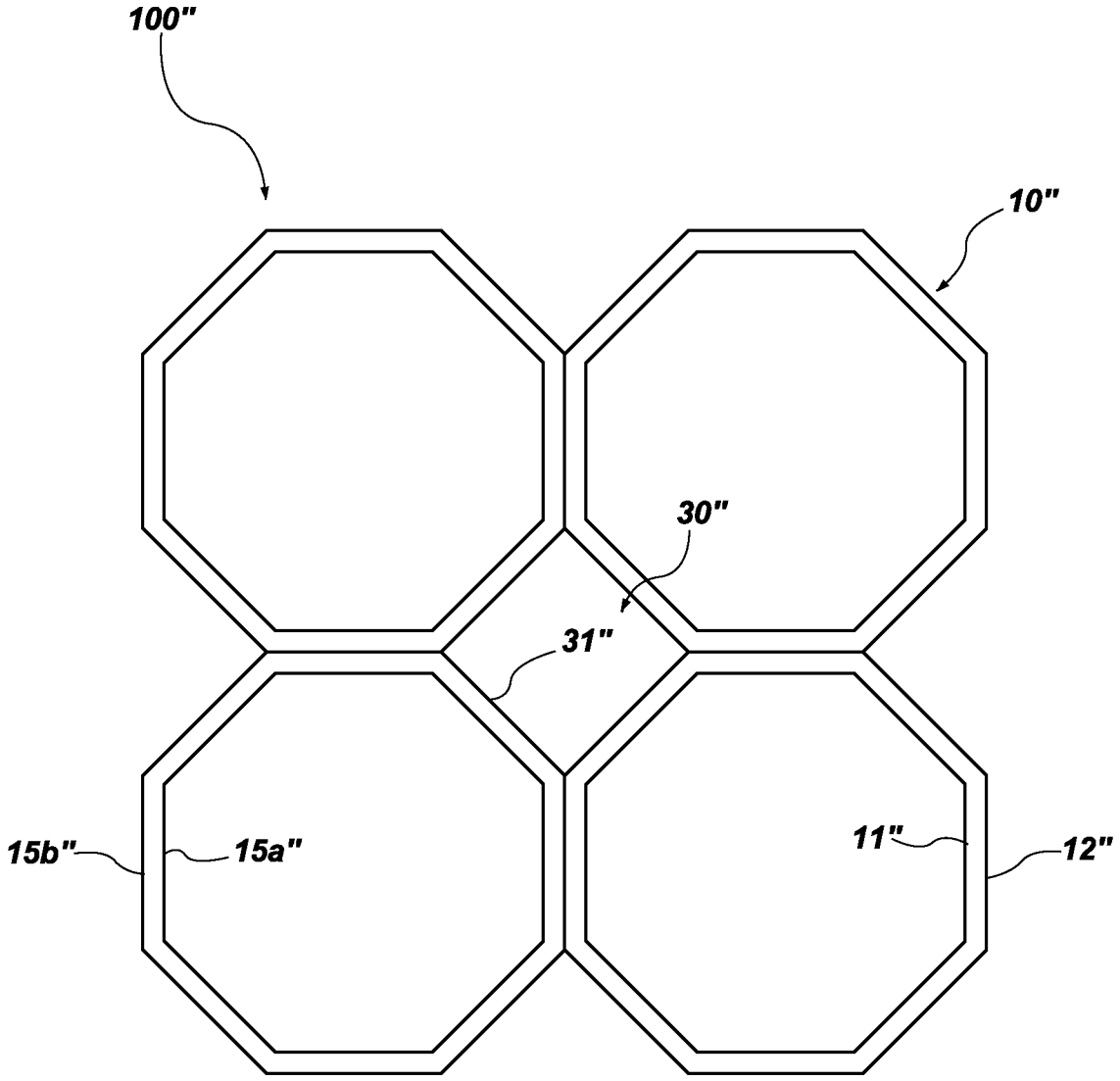
FIG. 4 is a partial top plan view of a second embodiment of a cushioning element.
Figure 5:
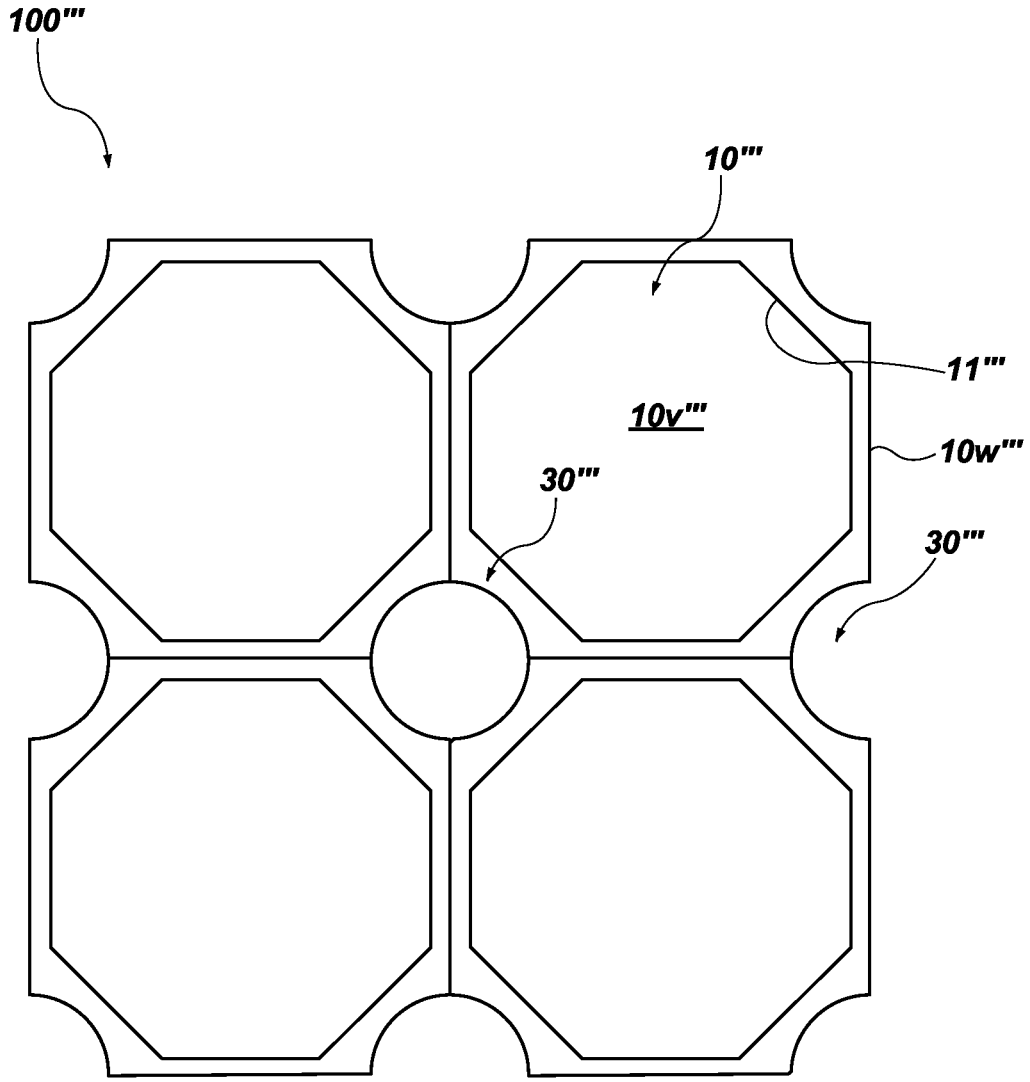
FIG. 5 is a partial top plan view of a third embodiment of a cushioning element.
Figure 6:
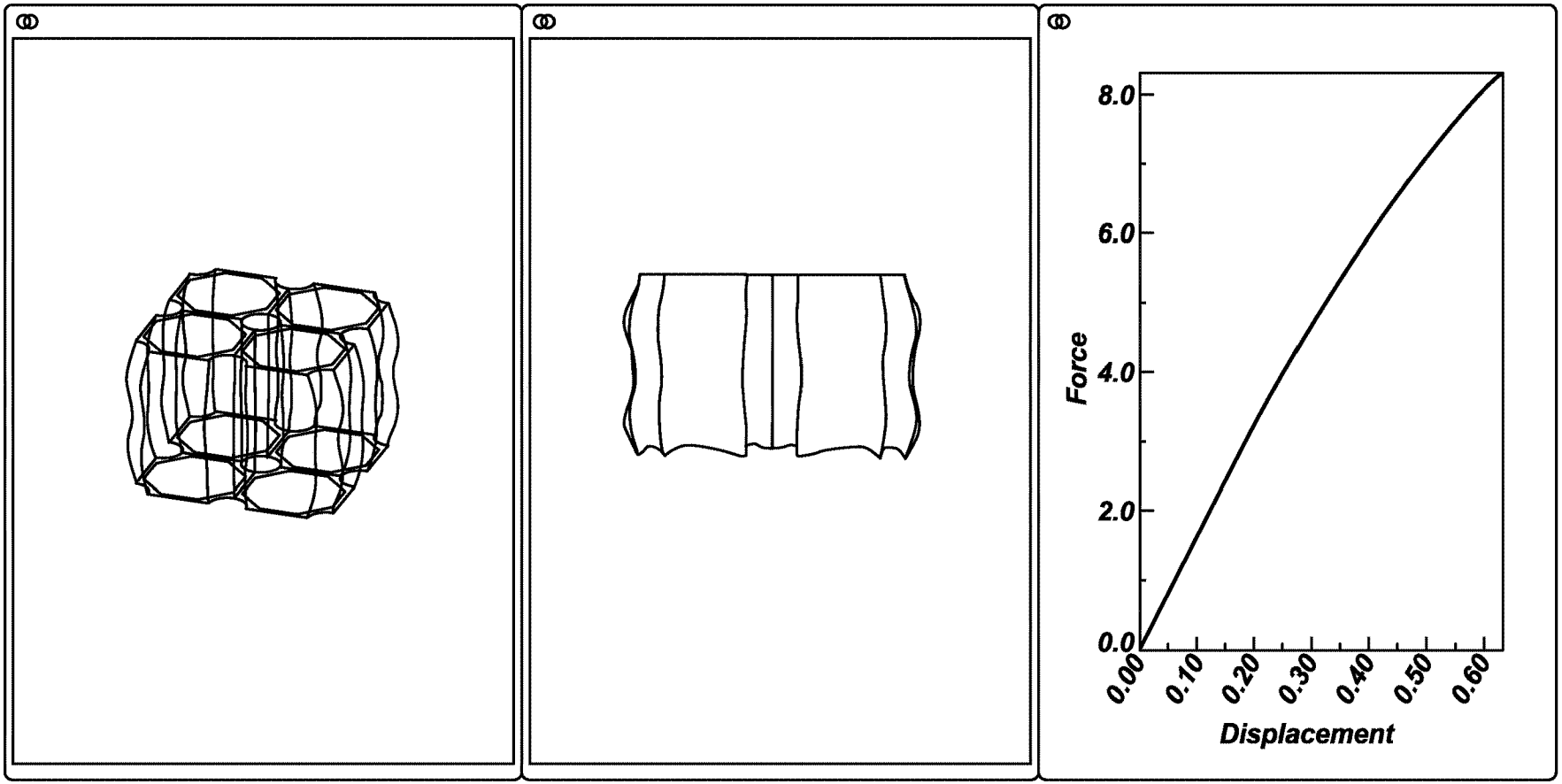
FIG. 6 illustrates a buckling profile for the cushioning element of FIG. 5.

FIGS. 4 and 5 illustrate additional embodiments of cushioning elements 100" and 100", respectively.

FIG. 4 illustrates a cushioning element 100" having substantially hollow columns 10" that are substantially cylindrical (e.g., regular octagonal hollow columns, etc.) and interspaces 30" that are cuboid (e.g., square, etc.) in shape. As illustrated in FIG. 4, the cushioning element 100" includes a plurality of hollow columns 10", each defined by a wall 15". The wall 15" includes shared portions 16", which are shared with adjacent hollow columns 10", and unshared portions 17", which are spaced apart from the other hollow columns 10" of a group (e.g., the four hollow columns 10" shown in FIG. 4). The wall 15", including its shared portions 16" and unshared portions 17", define an interior surface 11" of the hollow column 10", which devices a void 10*v*" of the hollow column 10". The unshared portions 17" of the wall 15", which are spaced apart from adjacent hollow columns 10", define an outer surface 12" of the hollow column 10". The interior surface 11" may include one or more interior faces 15*a*" and the outer surface 12" may include one or more exterior faces 15*b*". In some embodiments, the number of interior faces 15*a*" may be the same as the combined number of exterior faces 15*b*" and shared portions 16". In other embodiments, the number of interior faces 15*a*" may differ from the combined number of exterior faces 15*b*" and shared portions 16". A greater number of interior faces 15*a*" and/or exterior faces 15*b*" and shared portions 16" will bring the cross-sectional shapes of the inner surface 11" and/or outer surface 12", respectively, of the hollow column 10" closer in configuration to a hollow column 10, 10' with a circular cross-sectional shape, such as the embodiments of FIGS. 1-2C.

The shared portions 16" of the wall 15" of each hollow column 10" may approximate a function or arrangement of the lateral projections 20 of the embodiment of hollow column 10 shown in FIG. 1. The exterior faces 15*b*" of a group of hollow columns 10" may at least partially define the interspace 30" between the group of hollow columns 10". Accordingly, the interspace 130" may be constructed entirely of straight faces 31", giving rise to the cuboid configuration shown in FIG. 4 or any other configuration defined by the shapes of multi-sided columns that share portions of their walls. In such an embodiment of cushioning element 100", the hollow columns 10" may be larger than the interspaces 30".

FIG. 5 illustrates an embodiment of a cushioning element 100" with hollow columns 10'". Each hollow column 10'" has an inner surface 11'" and an outer surface 12'". Similar to the hollow columns 10 of the embodiment of cushioning element 100 shown in FIG. 1, each hollow column 10'" may include a void 10*v*'" that is cylindrical in shape and may, as depicted, have a cross-sectional shape taken perpendicular to the longitudinal axis, or height, of the hollow column 10'" that is substantially circular, imparting the hollow column 10'" with a smooth interior surface 11'". In contrast to the hollow columns 10 of the embodiment of cushioning element 100 shown in FIG. 1, the walls 10*w*'" of each hollow column 10'" may not have a curvature; i.e., the walls 10*w*'" may include flat faces. In the embodiment depicted by FIG. 5, the flat faces of the walls 10*w*'" may impart each hollow column 10'" with a cuboid shape, which may have a square cross-sectional shape, taken perpendicular to the longitudinal axis, or height, of the hollow column 10'". More specifically, the cross-sectional shape of each hollow column 10'", taken transverse to its height, may be octagonal. As illustrated, the cushioning element 100'" lacks any lateral projections.

The outer surfaces 12'" of a group of the hollow columns 10'" (e.g., a group of four hollow columns 10'" in FIG. 5, etc.) and the lateral projections 20'" that join adjacent hollow columns 10'" of the group define an interspace 30'" between the hollow columns 10'" of each group. Since the outer surfaces 12'" of the hollow columns 10'" and the lateral projections 20'" include substantially flat faces 31'", each interspace 30'" may have a polygonal cross-sectional shape (e.g., the octagonal shape shown in FIG. 5, etc.).

The hollow columns 10, 10', 10", 10'" and each of the interspaces 30, 30', 30", 30'" may have a buckling profile. Specifically, when a force is applied to the cushioning elements 100, 100', 100", 100'", the cylindrical hollow columns 10, 10', 10", 10'" and the interspaces 30, 30', 30", 30'" may buckle under the applied force. The lateral projections 20, 20', 20" may also buckle. The hollow columns 10, 10', 10", 10'" and the interspaces 30, 30', 30", 30'" may buckle along their longitudinal axes, respectively, where the longitudinal axes may be transverse or normal to the application of force. Examples of buckling profiles are illustrated and described in U.S. Pat. No. 7,076,822, titled "STACKED CUSHIONS," and issued on Jul. 18, 2006; U.S. Pat. No. 7,730,566, titled "MULTI-WALLED GELASTIC MATERIAL," and issued on Jun. 8, 2010; and U.S. Pat. No. 5,749,111, titled "GELATINOUS CUSHIONS WITH BUCKLING COLUMNS," and issued on May 12, 1998. The entire contents of each of the foregoing are herein incorporated by reference. In embodiments where the thickness of the lateral projections 20, 20', 20", 20'" differs from the thickness of the walls 10*w*, 10*w*', 10*w*", 10*w*'" of the hollow columns 10, 10', 10", 10'", the extent to which the lateral projections 20, 20', 20", 20'" and, thus, the interspaces 30, 30', 30", 30'" buckle may differ from the extent to which the hollow columns 10, 10', 10", 10'" buckle (e.g., interspaces 30, 30', 30", 30'" with lateral projections 20, 20', 20", 20'" that are thicker than the walls 10*w*, 10*w*', 10*w*", 10*w*'" of the hollow columns 10, 10', 10", 10'" may buckle to a lesser extent than the hollow columns 10, 10', 10", 10'", etc.).

Buckling of the hollow columns 10, 10', 10", 10'" and the interspaces 30, 30', 30", 30'" allows the cushioning element 100, 100', 100", 100'" to dynamically respond to applied forces, such as when a user lays down, rests, or steps on the cushioning element 100, 100', 100", 100'". Additionally, buckling of the hollow columns 10, 10', 10", 10'" and the interspaces 30, 30', 30", 30'" is limited by the joined lateral projections 20, 20', 20", 20'", which may prevent the cushioning elements 100, 100', 100", 100'" from bottoming out when the force is applied.

This means a user may experience a cushioning effect throughout an entire thickness of the cushioning element 100, 100', 100", 100'. The cushioning element 100, 100', 100", 100'" may form at least part of a mattress, a pillow, a seat cushion, a shoe insole, an anti-fatigue mat, or another appropriate type of cushion. Regardless of the type of cushion, the user may experience a cushioning effect throughout an entire thickness of the cushioning element 100, 100', 100", 100'".

Figure 7:
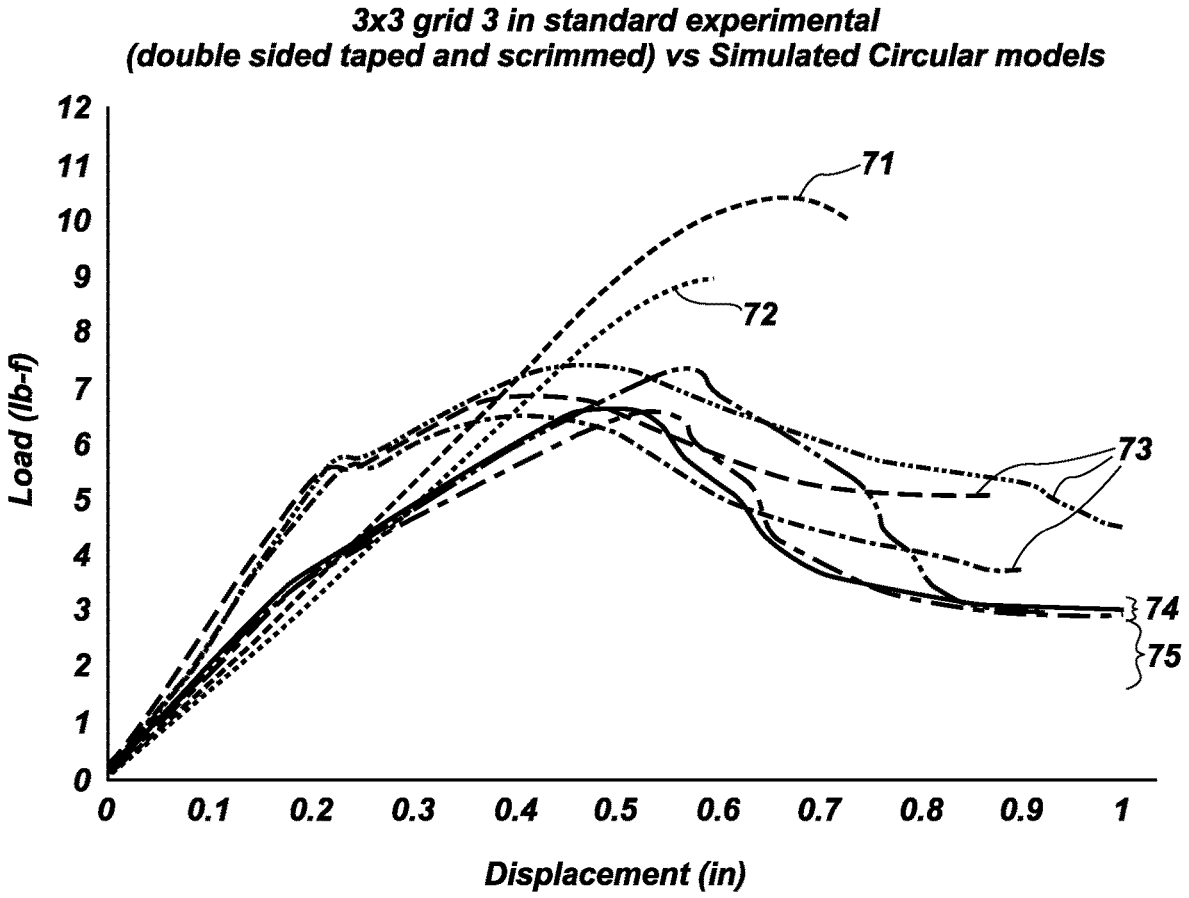
FIG. 7 is a graph showing the displacements of a 3×3 square grid, which each square having a cross-sectional area of about one square inch, with a thickness of three inches and the embodiments of cushioning elements shown in FIGS. 1, 4, and 5 under an applied force.
Figure 8A:
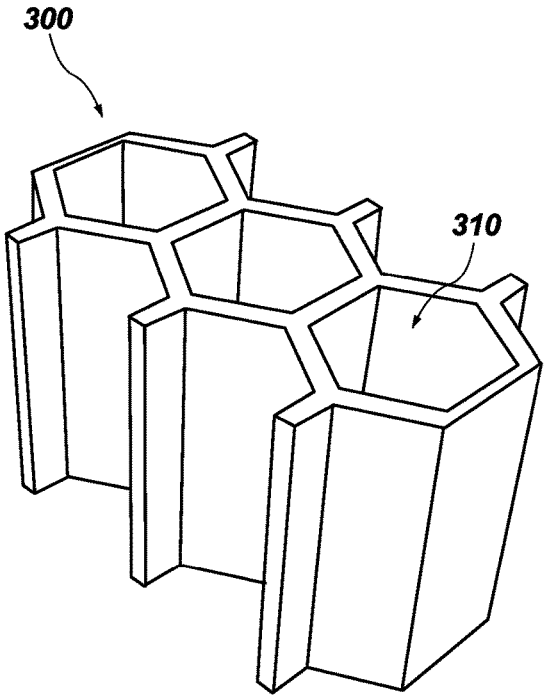
FIG. 8A illustrates a cushioning element having hexagonal hollow columns arranged in a hexagonal grid (i.e., by tessellation of regular hexagons, or organizing the regular hexagons adjacent to each other without overlaps or gaps)
Figure 8B:
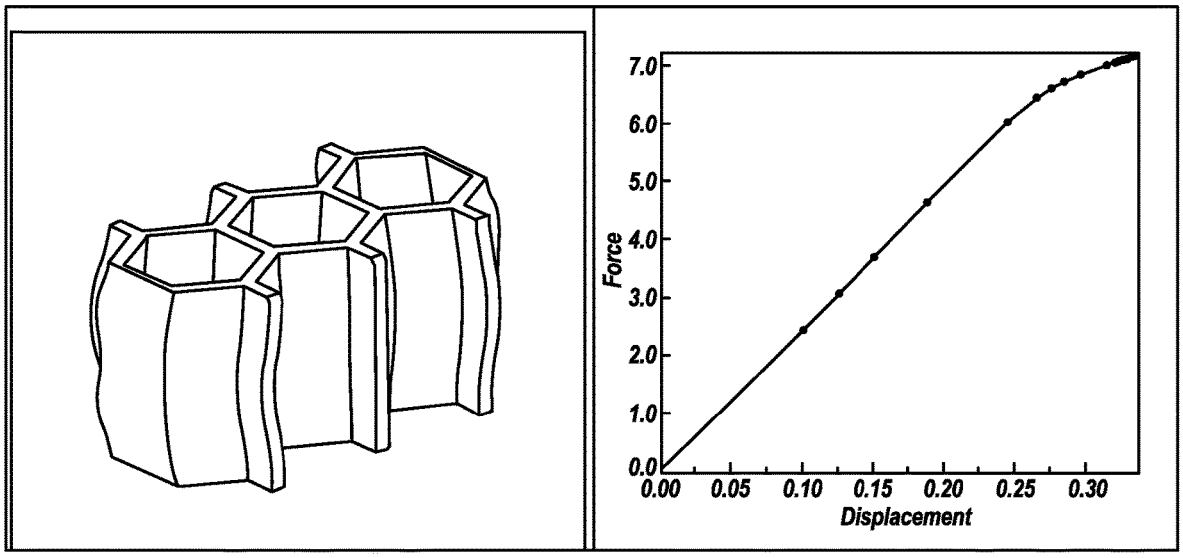
FIG. 8B illustrates a buckling profile for the cushioning element having hexagonal hollow columns arranged in a hexagonal grid.

FIG. 7 graphically illustrates a displacement of various cushioning elements. Line 71 shows the computer-simulated displacement (e.g., with an Instron tester, etc.) of a 3 inch by 3 inch array of a 3 inch thick, or 3 inch tall, hollow column 10, under an applied load (measured in pounds of force, lb-f), with the hollow columns of cushioning element starting to buckle under a load of about 9 lb-f. Line 72 shows the computer-simulated displacement of a 3 inch by 3 inch array of 4 inch thick, or 4 inch tall, hollow column 10 under an applied load, with the hollow columns of the cushioning element starting to buckle under a load of about 10.4 lb-f. Notably, the hollow columns 10 can withstand an applied load of about 9 lb-f (about 1 psi) or more before they start to buckle. Lines 73, 74, and 75 are provided for purposes of comparison, with lines 73 and 75 providing displacement data (e.g., with an Instron tester, etc.) from 3 inch by 3 inch sections of 4 inch thick square grid currently used in Purple mattresses and lines 74 providing displacement data (e.g., with an Instron tester, etc.) from 3 inch by 3 inch sections of 3 inch thick square grid currently used in Purple mattresses, which start to buckle under much smaller loads (e.g., under 6 lb-f in lines 73, about 6.5 lb-f to 7.5 lb-f in lines 74, and about 5 lb-f or less in lines 75). As another comparison, FIGS. 8A-8B, a cushioning element 300 with an array of regular hexagonal columns 310 that are about one inch across (as measured between parallel sides) starts to bottom out at 6.5 lb-f (about 0.7 psi).

FIGS. 9A and 9B graphically compare the weight and amount of material used for cushioning elements constructed from hollow columns that are cylindrical or substantially cylindrical (referred to as "optimized") and one inch square hollow columns (referred to as "standard"). Specifically, the data in FIGS. 9A and 9B relate to cushioning elements made for use in queen size mattresses. As seen in FIG. 9A, where the height of the cushioning elements is 3 inches, the cushioning element with optimized hollow columns weighs less than the cushioning element with standard hollow columns by more than 10 pounds (lbs). Specifically, a standard cushioning element for use in a queen size mattress with one inch square hollow columns that have a height of 3 inches weighs 65 lbs., while the cushioning element 100 with optimized hollow columns, which has a height of 3 inches and the same lateral dimensions as the cushioning element with standard one inch square (or diamond) hollow columns, weighs 51.57 lbs., a reduction of about 20%.

As seen in FIG. 9B, cushioning elements 100" (FIG. 4) and 100'" (FIG. 5) with heights of three inches with hollow columns 10" and 10'" that are octagonal and respectively have square interspaces 30" (FIG. 4) or circular interspaces 30'" (FIG. 5) respectively utilize 14% and 18.5% less material than cushioning elements having one inch square (or diamond) hollow columns that are three inches tall and a maximum dimension of about one inch across. The reduction in weight and material saves money in terms of both shipping costs and material costs.

Figure 10:
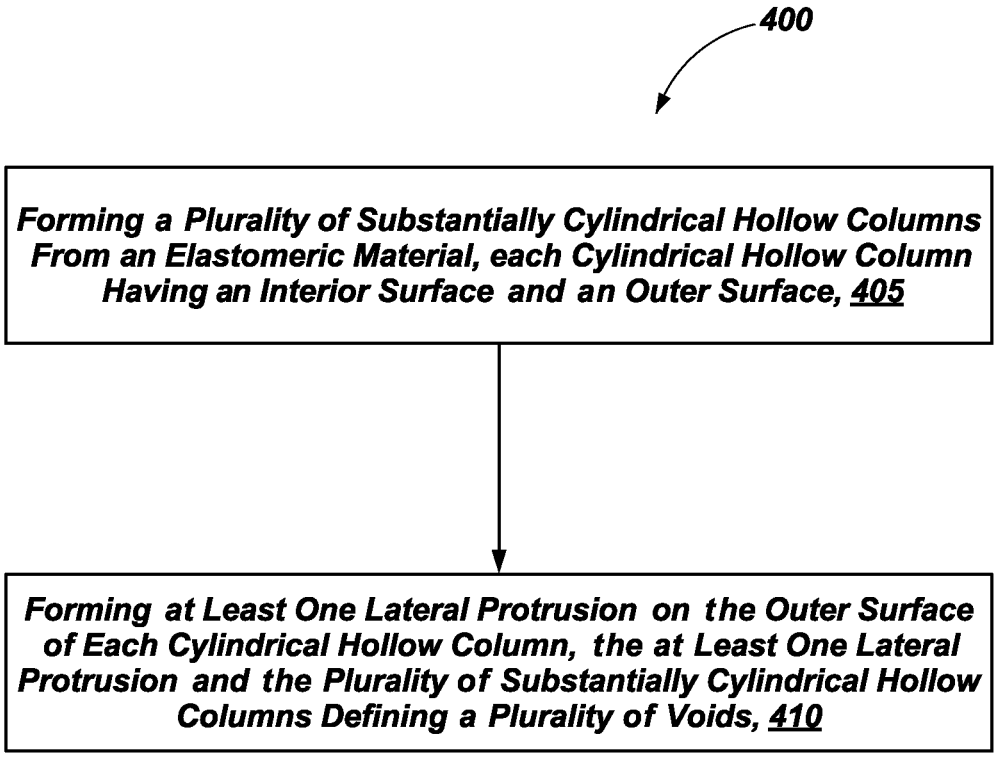
FIGS. 10-11 are flowcharts of embodiments of methods for forming a cushioning element.
Figure 11:
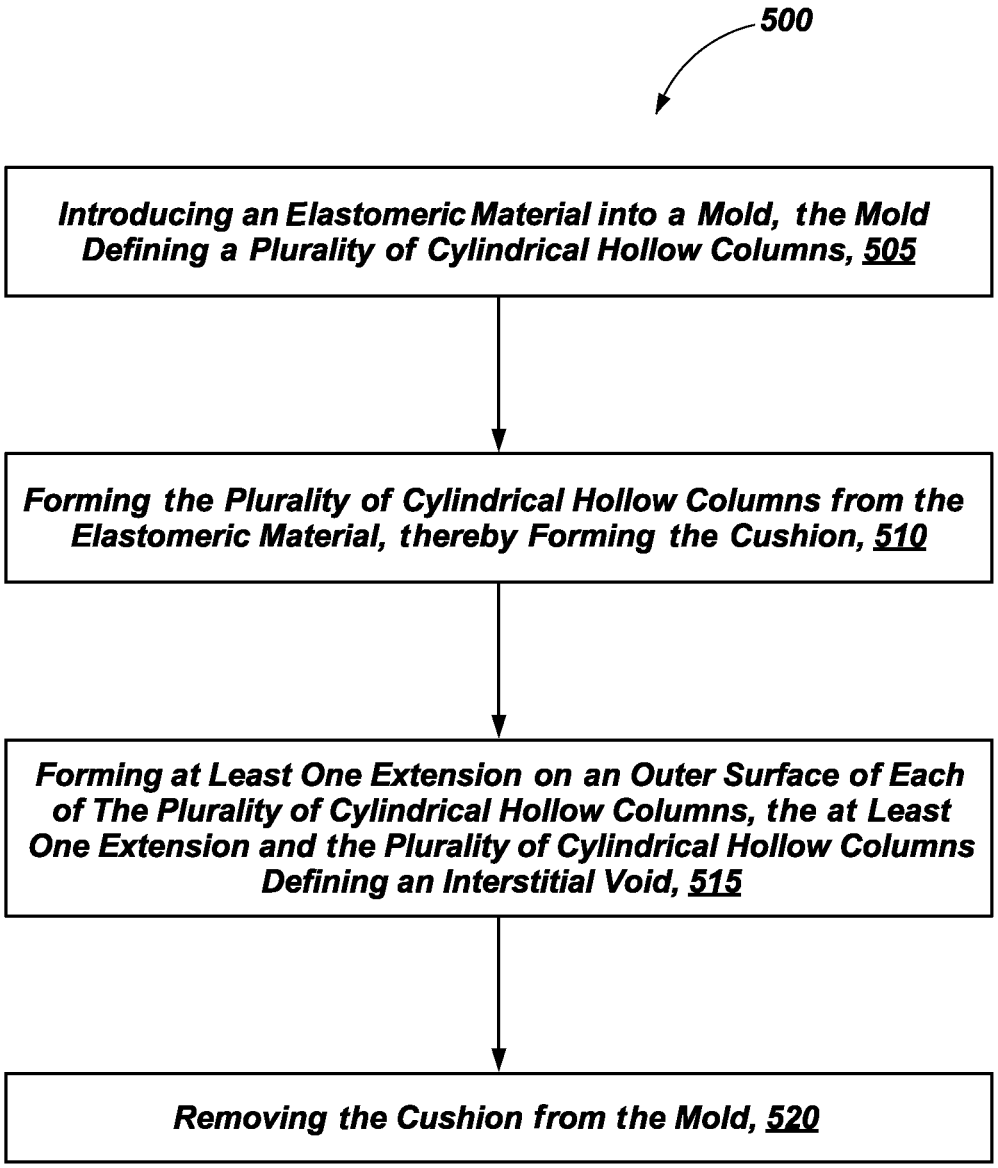

FIGS. 10-11 are flowcharts of methods for forming a cushioning element, such as cushioning elements 100, 100', 100", and 100'". In FIG. 10, a method 400 may include forming a plurality interconnected walls from an elastomeric material, with the interconnected walls defining hollow columns that are cylindrical or substantially cylindrical and interspaces between the hollow columns, at 405. For example, the plurality of hollow columns may be the hollow columns 10, 10', 10", and 10'" of FIGS. 1, 2A, 2B, 4 and 5. In some embodiments, the hollow columns are formed with smooth interior and outer surfaces. Formation of the walls may include forming lateral projections extending from the outer surface of each hollow column, where the at least one lateral projection and the plurality of hollow columns define a plurality of interspaces, at 410. Again, the plurality of interspaces may be the interspaces 30, 30', 30", 30" of FIGS. 1, 2A, 2B, 4, and 5, respectively. In some embodiments, the cushioning element may be formed on a stabilizing material (e.g., a thin fabric or "scrim"), which may stabilize the resulting cushioning element.

The plurality of hollow columns and interspaces may be formed or arranged in an array or grid. Additionally, the plurality of hollow columns and/or the interspaces may buckle under an applied force, or as a load is applied to them. In embodiments where both the hollow columns and the of a cushioning element can buckle under a load, the load under which they start to buckle and, thus, their buckling profiles, may differ from each other (e.g., the load required to cause walls of the hollow columns to buckle may be less than the load required to cause walls of the interspaces to buckle, etc.). Buckling of the hollow columns and/or the interspaces may allow the cushioning element to dynamically respond to applied forces and prevent bottoming out of any portion of the cushioning element.

In FIG. 11, method 500 may include introducing an elastomeric material into a mold, the mold defining a plurality of hollow columns that are cylindrical or substantially cylindrical, at 505. In some embodiments, the mold is outfitted with a thin fabric or scrim material and the elastomeric material is introduced into the mold over the scrim material. The method 500 may include forming interconnected walls that define the plurality of hollow columns from the elastomeric material, thereby forming the cushioning element, at 510. The scrim material in the mold may act as a stabilizing material for the cushioning element. As before, the plurality of hollow columns may be the hollow columns 10, 10', 10", 10'" of FIGS. 1, 2A, 2B, 4, and 5. In some embodiments, the hollow columns are formed with smooth interior and outer surfaces. Forming the interconnected walls may include forming projections on an outer surface of each of the plurality of hollow columns, projections and the plurality of hollow columns defining an interspace between a group of hollow columns, at 515. The method 500 may include removing the cushion from the mold, at 520. The smooth interior and outer surfaces of the plurality of hollow columns may facilitate an easy removal of the cushion from the mold.

Although this disclosure provides many specifics, these should not be construed as limiting the scope of any of the claims that follow, but merely as providing illustrations of some embodiments of elements and features of the disclosed subject matter. Other embodiments of the disclosed subject matter, and of their elements and features, may be devised which do not depart from the spirit or scope of any of the claims. Features from different embodiments may be employed in combination. Accordingly, the scope of each claim is limited only by its plain language and the legal equivalents thereto.

What is claimed:

1. A cushion comprising:

an elastomeric cushioning material defining:

a plurality of hollow columns that are cylindrical or substantially cylindrical;

at least one lateral projection extending from an outer surface of each of the hollow columns, the at least one lateral projection joining a hollow column of the plurality of hollow columns with an adjacent hollow column of the plurality of hollow columns; and a plurality of interspaces defined between walls defining the hollow columns and at least partially defined by lateral projections of the hollow columns, wherein the plurality of hollow columns have a first buckling profile and the walls and the lateral projections that at least partially define the plurality of interspaces have a second buckling profile different than the first buckling profile, such that the plurality of hollow columns begin to buckle under a different applied force than the walls and the lateral projections that at least partially define the plurality of interspaces start to buckle.

2. The cushion of claim 1, wherein the plurality of hollow columns is arranged in a grid.

3. The cushion of claim 1, further comprising a fabric material on a surface of the elastomeric cushioning material and for stabilizing the elastomeric cushioning material.

4. The cushion of claim 1, wherein the plurality of hollow columns define buckling columns, with each buckling column of the buckling columns has a longitudinal axis extending through a thickness of the cushion along with the buckling column buckles.

5. The cushion of claim 1, wherein the plurality of hollow columns begin to buckle under an applied force of at least about 9 lb-f.

6. A cushion comprising:

an elastomeric cushioning material defining:

a plurality of hollow columns that are cylindrical or substantially cylindrical positioned adjacent to each other, each hollow column having a first cross-sectional shape and/or size, taken perpendicular to a height of the hollow column; and a plurality of interspaces, each interspace defined by walls defining a group of hollow columns and having a second cross-sectional shape and/or size, taken perpendicular to a height of the interspace, that differs from the first cross-sectional shape and/or size, wherein the plurality of hollow columns have a first buckling profile based at least in part on the first cross-sectional shape and/or size, and the walls that define the plurality of interspaces have a second buckling profile based at least in part on the second cross-sectional shape and/or size, the second buckling profile being different than the first buckling profile.

7. The cushion of claim 6, further comprising a plurality of lateral projections spacing adjacent hollow columns of the plurality of hollow columns apart from each other, walls defining a group of hollow columns of the plurality of hollow columns and a group of lateral projections joining the group of hollow columns together defining an interspace of the plurality of interspaces between the group of hollow columns.

* * * * *